United States Patent [19]

Coburn

[11] 4,194,662

[45] Mar. 25, 1980

[54] WEB DIRECTOR

[75] Inventor: Robert E. Coburn, Warminster, Pa.

[73] Assignee: Molins Machine Company, Inc., Cherry Hill, N.J.

[21] Appl. No.: 937,397

[22] Filed: Aug. 28, 1978

[51] Int. Cl.[2] ..... B65H 17/42

[52] U.S. Cl. ..... 226/110; 83/105

[58] Field of Search ..... 271/9, 64; 226/91, 109, 226/110; 83/105, 106, 107

[56] References Cited

U.S. PATENT DOCUMENTS

| | | | |
|---|---|---|---|
| 3,478,654 | 11/1969 | Willard | 226/109 X |
| 3,575,331 | 4/1971 | Middleman | 226/199 |
| 3,679,117 | 7/1972 | Moss | 226/109 X |

*Primary Examiner*—Richard A. Schacher

*Attorney, Agent, or Firm*—Seidel, Gonda, Goldhammer & Panitch

[57] ABSTRACT

A plurality of flexible panels are disposed side by side and extending in the direction of movement of a web. The panels are supported intermediate their ends by a fulcrum means transverse to the web path. A discrete power means is coupled to each end of each panel for selectively and independently raising and lowering the free ends of the panels while flexing the panels.

6 Claims, 2 Drawing Figures

WEB DIRECTOR

BACKGROUND

This invention relates generally to the cutting of a continuously moving web, and more particularly, to means for selectively directing segments of a slit moving web of double face corrugated paperboard between a slitter-scorer machine and a cut-off machine.

A corrugated paperboard web has traditionally been slit by a rotatable turret-machine known generally as a "triplex". A triplex includes three sets of shafts provided with rotary slitter knives and scoring heads. The shafts are mounted on a rotatable turret so that one pair of shafts, generally the pair temporarily disposed at the top, is actively cutting the web while the lower pairs are inoperative whereby an operator may reset the heads on the lower pairs of shafts. Since the paperboard web was always fed at the same elevation, web directors for guiding the web to and from the triplex were relatively simple. For example, see U.S. Pat. Nos. 3,307,441 and 3,489,043.

At the end of a production run, it was necessary to slit the web transversely and slow down the speed of the web to thereby provide a gap in the web to facilitate indexing the triplex for the next production run. Reducing the speed of the web not only impedes production but is deleterious to the quality of the corrugated paperboard. To overcome these problems, the slitter-scorer was changed so that the web was alternately fed at different elevations. For example, see U.S. Pat. Nos. 3,831,502; 3,882,765; and 4,041,819.

Each of the web directors described in the aforementioned patents for feeding webs selectively from different elevations is complex and expensive. Furthermore, the large number of movable members renders the apparatus dangerous to operators, particularly if a jam occurs whereby it is necessary for the operator to reach into the machine.

In view of the demand by the industry for slitter-scorers requiring negligible time for changing from one production order to another production order, bi-level slitter-scorers have gained wide acceptance. Accordingly, there is now a great need for a simple, safe, and inexpensive web director which can feed a web from any one of two elevations of a slitter-scorer to any one of two elevations at a cut-off machine.

SUMMARY OF THE INVENTION

The present invention is directed to a web director preferably adapted for directing a web between a slitter-scorer machine and a cut-off machine. The web director includes a frame having a fulcrum means which is transverse to the web path. A plurality of flexible panel means are disposed side by side and extending in a direction corresponding to the web path. Thus, each flexible panel means is generally perpendicular to the fulcrum means. Each panel means has two free ends with an intermediate portion coupled to the fulcrum means.

A discrete power means is coupled to each free end of each panel means for selectively and independently raising and lowering the free ends while flexing the associated panel means. In this manner, a web may be fed to the inlet side of said panel means and supported thereby at either of two elevations and be discharged to either of two elevations on the outlet side of said panel means.

It is an object of the present invention to provide a web director which is simple, inexpensive and reliable.

It is another object of the present invention to provide a web director which is simple, inexpensive, and has a minimum number of components while being capable of selectively receiving a web at either of two elevations and discharging the web at either of two elevations.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
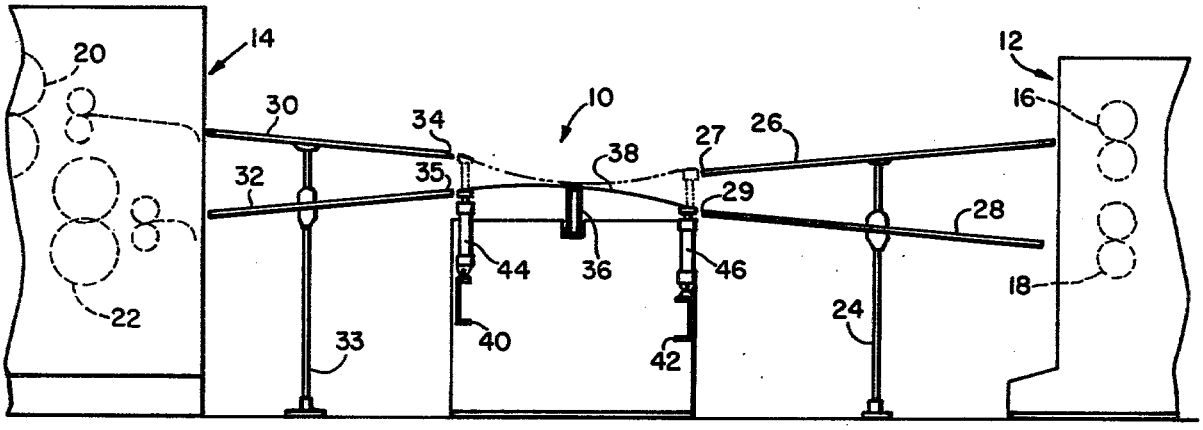
FIG. 1 is a side elevation of apparatus in accordance with the present invention.

Referring to the drawings in detail, wherein like numerals indicate like elements, there is shown in FIG. 1 a web director in accordance with the present invention designated generally as 10. Web director 10 is disposed for purposes of illustration between the discharge end of a slitter-scorer machine 12 and the inlet end of a cut-off machine 14.

The slitter-scorer machine 12 is of the bi-level type having an upper set of rolls 16 and a lower set of rolls 18. Thus, the slitter-scorer machine 12 may discharge a web at two different elevations corresponding to the elevations of said sets of rolls 16 and 18. The cut-off machine 14 is capable of receiving webs at two different elevations for further processing. Thus, the cut-off machine 14 includes an upper set of rolls 20 and a lower set of rolls 22.

An upper feed guide 26 and a lower feed guide 28 are disposed between the web director 10 and the discharge end of the slitter-scorer machine 12. The guides 26, 28 are supported by support structure 24. The guides 26 and 28 are stationary, flat plates which converge in a downstream direction and have their respective ends 27, 29 spaced from one another and disposed one above the other as shown in FIG. 1. The length of the guides 26, 28 in the direction of the movement of the web path is optional.

Between the web director 10 and the inlet side of the cutoff machine 14, there is provided an upper delivery guide 30 and a lower delivery guide 32. The guides 30, 32 are stationary, flat plates supported by the support structure 33. Guides 30, 32 have free ends 34, 35 respectively. The guides 30, 32 converge in an upstream direction toward the web director 10.

The upper end of the upper feed guide 26 is positioned to receive a web from the upper set of rolls 16 and deliver the same to the web director 10. The lower end of the lower feed guide 28 is positioned to receive the web from the lower set of rollers 18 and deliver the same to the web director 10. The upper delivery guide 30 is positioned so as to receive a web from the web director 10 and deliver the same to the upper set of rolls 20 of the cut-off machine 14. The lower delivery guide 32 is positioned to receive a web from the web director 10 and deliver it to the lower set of rolls 22 of the cut-off machine 14.

Figure 2:
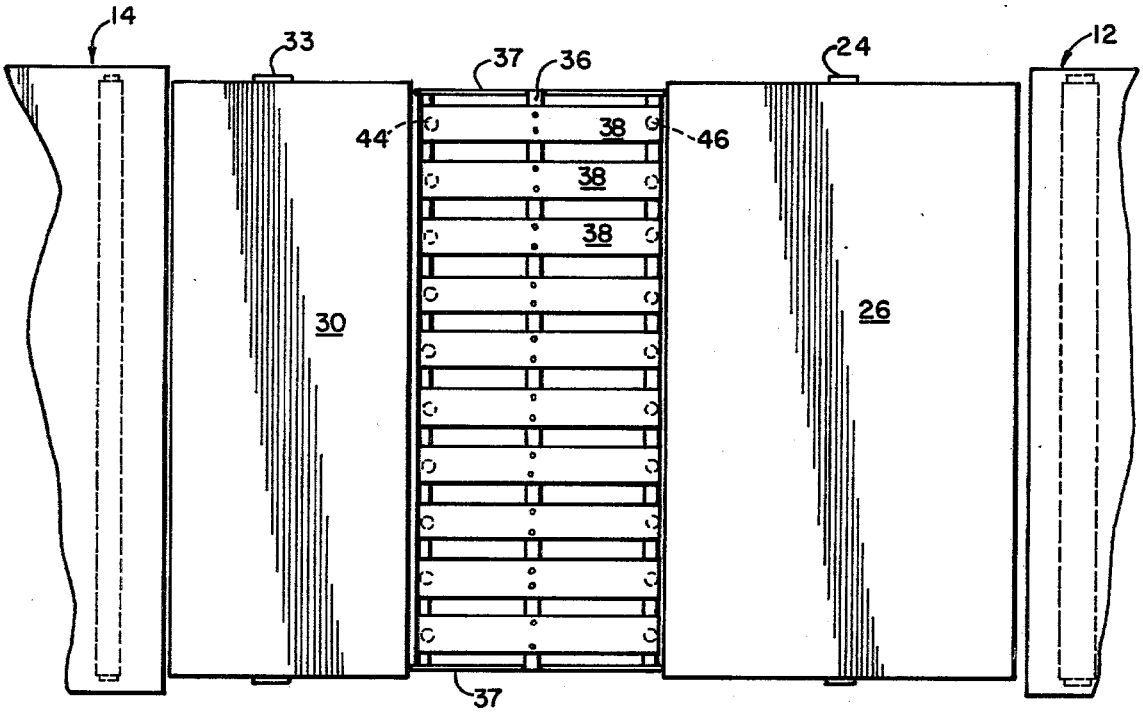
FIG 2 is a top plan view of FIG. 1.

The web director 10 includes a fulcrum 36 supported by end frames 37. The fulcrum 36 extends transversely of the web path and may be conveniently made from a generally rectangular hollow tube as shown or from a U-shaped channel. As shown more clearly in FIG. 2, a plurality of flexible panels 38 have an intermediate portion thereof fixedly secured to the upper surface fulcrum 36 by fasteners. The fasteners are recessed in the upper surface of the panels. As an alternate, each panel 38 could be welded to a flanged adaptor which is removably bolted to fulcrum 36. The panels 38 extend in the direction of the flow path and have a length sufficient so as to have one of their free ends adjacent one of the ends of the guides 26, 28 or 34, 35. Beams 40 and 42 extend between the side frames 37 on opposite sides thereof. A plurality of fluid power means such as pneumatic cylinders 44, corresponding to the number of panels 38, are supported by the beam 40. A similar number of cylinders 46 are supported by the beam 42. Each panel 38 has one of its free ends connected to a piston rod associated with a cylinder 44 and has its other free end connected to a piston rod associated with a cylinder 46.

Each of the panels 38 is made from a flexible, resilient material such as spring steel, fiberglass reinforced plastic, etc. The material of panels 38 is preferably non-corrosive. Each of the cylinders 46 has a piston rod stroke sufficient to selectively position the free end of its associated panel 38 in a location for receiving a web from either of the guide ends 27 or 29. Likewise, each of the cylinders 44 has a piston rod stroke sufficient to position the associated end of panel 38 in a location to deliver a web to either of the guide ends 34, 35. The cylinders 44, 46 are selectively and independently operable. In this manner, each of the panels 38 may have their inlet ends at a common elevation while the outlet end of some of the panels 38 may be in an upper position while others are in a lower position so that the web director may simultaneously feed a portion of the slit web to each of the elevations of the cut-off machine 14. The width of the panels 38 may be varied as desired. A suitable width for the panels 38 is 6 inches wide.

For purposes of illustration, let it be assumed that a web is being slit and scored at the slitter-scorer machine 12 by the upper set of rolls 16. All of the cylinders 46 will have their piston rods stroked so as to elevate the ends of their associated panels 38 to the phantom position shown in FIG. 1. The slit paperboard web received by the web director 10 may be fed to either the upper set of rolls 20 or the lower set of rolls 22. Alternatively, one portion of the slit web may be delivered to the upper set of rolls 20 while the remaining portion of the slit web may be delivered to the lower set of rolls 22.

It will be assumed that it is intended to direct the entire slit web to the upper set of rolls 20 of the cut-off machine 14. Hence, all of the cylinders 44 will have their pistons stroked so as to elevate the discharge ends of the panels 38 to the phantom position shown in FIG. 1. Since the point at which the panels 38 are attached to the fulcrum 36 is above the elevation of ends 29, 35 but below the elevation of the ends 27, 34, the panels 38 flex into a concave position and constitute a transition support for the web between the guides 26, 30.

While the paperboard web was being processed by the upper set of rolls 16 of the slitter-scorer machine 12, the heads on the lower set of rolls 18 were prepositioned for the next production run in a known manner. At the end of a production run, the paperboard web is fed to the lower set of rolls 18 and discharges therefrom onto the lower feed guide 28. Let is be assumed that the web of the next production order is desired to be fed to the lower set of rolls 22 of the cut-off machine 14. As the leading edge of the web for the next production order approaches the web director 10, the cylinders 44, 46 are stroked to their lowermost position as shown in solid lines in FIG. 1 whereby the panels 38 are in a convex position so as to constitute a transition support between the ends 29, 35. The control means for the cylinders 44, 46 may be of known construction and may be preprogrammed in accordance with the production orders. One type of control which could be used is disclosed in U.S. Pat. No. 3,307,441.

The preferred construction of the present invention utilizes stationary upper and lower guides 26, 28, 30, 32 in conjunction with a plurality of flexible panels whereby a web may be fed to the inlet side of the panels and supported thereby at either of two elevations and be discharged therefrom to either of two elevations on the outlet or discharge side of the panels. The number of movable components is minimized while at the same time providing a web director which is simple, inexpensive and reliable.

The present invention may be embodied in other specific forms without departing from the spirit or essential attributes thereof and, accordingly, reference should be made to the appended claims, rather than to the foregoing specification, as indicating the scope of the invention.

It is claimed:

1. A web director comprising:

(a) a frame having a fulcrum means, said fulcrum means being transverse to an intended web path, (b) a plurality of flexible panel means disposed side by side and extending in a direction generally perpendicular to said fulcrum means, each panel means having two free ends, means coupling an intermediate portion of each panel means to said fulcrum means, (c) a discrete power means coupled to each free end of each panel means for selectively and independently raising and lowering said free ends while flexing the associated panel means so that a web may be fed to the upstream end of said panel means and supported thereby at either of two elevations and may be discharged therefrom to either of two elevations on the downstream end of said panel means.

2. A web director in accordance with claim 1 including upper and lower feed guides which converge in a downstream direction toward the upstream end of said panel means, upper and lower delivery guides converging in an upstream direction toward the downstream end of said panel means, each panel means being sufficiently flexible so that each free end portion thereof may flex between the elevations of the adjacent ends of said guide means.

3. A web director in accordance with claim 2 wherein said panel means are fixedly secured to said fulcrum means at an elevation which is below the elevation of the adjacent ends of the upper guides but above the elevation of the adjacent ends of the lower guides.

4. A web director in accordance with claim 1 wherein said panel means are substantially longer than their width.

5. A web director comprising:

(a) stationary upper and lower guides converging in an intended direction of a web path, the downstream ends of said guides being disposed at first and second elevations, (b) stationary upper and lower delivery guides downstream from and spaced from first-mentioned guides, said delivery guides converging in an upstream direction and having their upstream ends at elevations corresponding generally to said first and second elevations, (c) a frame having a fulcrum means between said ends of said guides, said fulcrum means extending transverse to said intended web path, (d) a plurality of flexible panels disposed side by side and extending in a direction generally perpendicular to said fulcrum means, each panel having a central portion secured to said fulcrum means, (e) a discrete power means connected to each end of each panel for selectively flexing the panels and moving the panel ends to either one of said elevations.

6. A web director in accordance with claim 5 wherein said panel is fixedly secured to said fulcrum at an elevation which is below the elevation of the adjacent ends of the upper guides but above the elevation of the adjacent ends of the lower guides.

* * * * *